US006216567B1

(12) United States Patent
Hu

(10) Patent No.: US 6,216,567 B1
(45) Date of Patent: Apr. 17, 2001

(54) RATCHETING TOOLS HAVING AN ANGLE-ADJUSTABLE HEAD

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 09/434,539

(22) Filed: Nov. 5, 1999

(51) Int. Cl.[7] ..... B25B 23/16
(52) U.S. Cl. ..... 81/177.9; 81/177.7; 81/177.6
(58) Field of Search ..... 81/177.9, 177.7, 81/177.6

(56) References Cited

U.S. PATENT DOCUMENTS 6,000,302 * 12/1999 Chiang .

* cited by examiner

*Primary Examiner*—Joseph J. Hail, III
*Assistant Examiner*—Willie Berry, Jr.
(74) *Attorney, Agent, or Firm*—Alan Kamrath; Rider Bennett Egan & Arundel, LLP.

(57) ABSTRACT

A ratcheting tool includes a head including an end with an arcuate toothed face and a handle having an end defining a compartment for pivotal connection with the end of the head. The handle includes a longitudinal hole having an inner end and an outer end communicated with the compartment. The handle further includes a transverse hole communicated with the inner end of the longitudinal hole. A catch is mounted in the longitudinal hole and includes a first end with an arcuate toothed surface and a second end. A push button is mounted in the transverse hole and includes a stem, the stem including a relatively higher portion and a relatively lower portion. An elastic member biases the push button to a retaining position in which the second end of the catch engages with the relatively higher portion of the stem such that the arcuate toothed surface of the catch is biased to engage with the arcuate toothed face of the head, thereby retaining the head in an angular position relative to the handle. When the push button is pushed, the second end of the catch is disengaged from the relatively higher portion of the stem such that the arcuate toothed surface of the catch is disengaged from the arcuate toothed face of the head, thereby allowing adjustment of angular position of the head relative to the handle.

4 Claims, 23 Drawing Sheets

RATCHETING TOOLS HAVING AN ANGLE-ADJUSTABLE HEAD

BACKGROUND OF THE INVENTION

1. Field of the Invention

The present invention relates to ratcheting tools of the type having a head that is finely adjustable in an angular position relative to a handle.

2. Description of the Related Art

FIGS. 14 and 15 of the drawings illustrate a conventional ratcheting tool having a head 10' adjustable relative to a handle 20'. The head 10' includes an extension 11' with a number of teeth 12' formed on an end thereof. An end of the handle 20' includes two walls having a compartment 21' defined therebetween. A pin 22' is extended through aligned holes (one of them is a screw hole) of the walls of the end of the handle 20' and through a hole (not labeled) in the extension 11' of the head 10'. A longitudinal hole 26' and a transverse hole 27' are defined in the handle 20' and located below the walls, wherein an upper end of the longitudinal hole 26' communicates with the compartment 21' and the transverse hole 27' intersects the longitudinal hole 26' at a mediate portion of the latter. A spring 28' and a ball 29' are mounted in a lower portion of the longitudinal hole 26'. A push pin 30' is extended through the transverse hole 27' and includes a positioning notch 31' in an underside thereof for engaging with the ball 29'. The push pin 30' further includes an inclined face 32' in an upper side thereof. The push pin 30' has a length greater than that of the transverse hole 27' such that two ends of the push pin 30' are exposed outside the handle 20' for manual operation. A ball 33', a spring 34', and a catch 35' are mounted in an upper portion of the longitudinal hole 26', best shown in FIG. 15. The catch 35' includes a receptacle 36' for receiving the spring 34' and a portion of the ball 33' that rests on the inclined face 32'. The catch 35' further includes an inclined underside 37' having the same inclination as the inclined face 32'. The catch 35' is biased upward by the spring 34' to engage with the teeth 12' of the head 10', thereby retaining the head 10' in a desired angular position with respect to the handle 20'. When the push pin 30' is pushed, the lower ball 29' is lowered and the upper ball 33' is also lowered, as shown in FIG. 15. The upper spring 34' and the catch 35' are also lowered such that the catch 35' disengages from the teeth 12' of the head 10'. Thus, the head 10' may be pivoted to a desired angular position relative to the handle 20' and the push pin 30' is then released to thereby retain the head 10' in the desired angular position.

Nevertheless, such an arrangement is too complicated (two sets of balls and springs are required) and has limited angular adjustment, since there are only six teeth 12' on the head 10'. The ratcheting tool cannot perform its function if the fastener to be tightened/loosened is located in a position that cannot be reached by the five angular positions of the head. The retaining function of the catch 35' by only one tooth is also too small and thus incapable of reliably retaining the head 10' in place. A further drawback of the complicated structure is that the catch 35' and the teeth 12' tend to disengage from each other when the balls 29' and 33' and the springs 28' and 34' are impinged.

FIGS. 16 through 18 of the drawings illustrate another conventional ratcheting tool having a head 110' adjustable relative to a handle 120'. The head 110' includes an extension 111' with a number of teeth 112' formed on an end thereof. An end of the handle 120' includes two walls having a compartment 121' defined therebetween. A pin 122' is extended through aligned holes (one of them is a screw hole) of the walls of the end of the handle 120' and through a hole (not labeled) in the extension 111' of the head 110'. A longitudinal hole 127' and a transverse hole 126' are defined in the handle 120' and located below the walls, wherein an upper end of the longitudinal hole 127' communicates with the compartment 121' and the transverse hole 126' intersects the longitudinal hole 127' at a lower portion of the latter. A turnknob 128' includes a stem 133' extended through the transverse hole 126' and having a stem 133' with a higher profile portion 135' and a lower profile portion 134'. A ball 129', a spring 130', and a catch 131' are mounted in an upper portion of the longitudinal hole 127', best shown in FIG. 17. The catch 131' includes a receptacle 136' for receiving the spring 130' and the ball 129' that rests on the stem 133'. The catch 131' further includes a tooth 137' for engaging with the teeth 112' of the head 110'. When the ball 130' rests on the higher profile portion 135' (FIG. 18), the catch 131' is biased upward by the spring 130' to engage with the teeth 112' of the head 110', thereby retaining the head 110' in a desired angular position with respect to the handle 120'. When the turnknob 128' is turned to a position in which the ball 130' rests on the lower profile portion 134', the ball 130' is lowered. The spring 130' and the catch 131' are also lowered such that the tooth 137' of the catch 131 ' disengages from the teeth 112' of the head 110'. Thus, the head 110' may be pivoted to a desired angular position relative to the handle 120' and the turnknob 128' is then turned to the initial position to thereby retain the head 110' in the desired angular position.

Nevertheless, such an arrangement is still too complicated and has limited angular adjustment, since there are only six teeth 112' on the head 110'. The ratcheting tool cannot perform its function if the fastener to be tightened/loosened is located in a position that cannot be reached by the five angular positions of the head. The retaining function of the catch 131' by only one tooth is also too small and thus incapable of reliably retaining the head 110' in place. In addition, the user must use both hands to proceed with such adjustment.

SUMMARY OF THE INVENTION

It is a primary object of the present invention to provide a ratcheting tool having a head finely adjustable in an angular position relative to a handle, wherein the ratcheting tool is simpler in structure to allow easy manufacture and assembly and to reduce potential malfunction possibility. Adjustment of the angular position of the head relative to the handle is accomplished by pushing a push button to allow adjustment and then releasing the push button to retain the head in place.

A ratcheting tool in accordance with the present invention comprises:

- a head including an end with an arcuate toothed face;
- a handle including an end defining a compartment for pivotal connection with the end of the head, the handle including a longitudinal hole having an inner end and an outer end communicated with the compartment, the handle further including a transverse hole communicated with the inner end of the longitudinal hole;
- a catch mounted in the longitudinal hole and including a first end with an arcuate toothed surface and a second end;
- a push button mounted in the transverse hole and including a stem, the stem including a relatively higher portion and a relatively lower portion; and means for biasing the push button to a retaining position in which the second end of the catch engages with the relatively higher portion of the stem such that the arcuate toothed surface of the catch is biased to engage with the arcuate toothed face of the head, thereby retaining the head in an angular position relative to the handle, and wherein when the push button is pushed, the second end of the catch is disengaged from the relatively higher portion to of the stem such that the arcuate toothed surface of the catch is disengaged from the arcuate toothed face of the head, thereby allowing adjustment of the angular position of the head relative to the handle.

A reduced hole may be intercommunicated between the transverse hole and the inner end of the longitudinal hole. The second end of the catch includes a stub extended through the reduced hole, and an elastic member is mounted around the stub for assisting in bias of the catch toward the head when the push button is in its retaining position.

The stem of the push button includes an inclined surface for engaging with the second end of the stem. In an embodiment of the invention, the transverse hole includes a countersink in an end thereof to define an end wall. The push button includes a button head from which the stem extends. The biasing means is an elastic member mounted around the stem, located in the countersink, and attached between the end wall and the button head.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
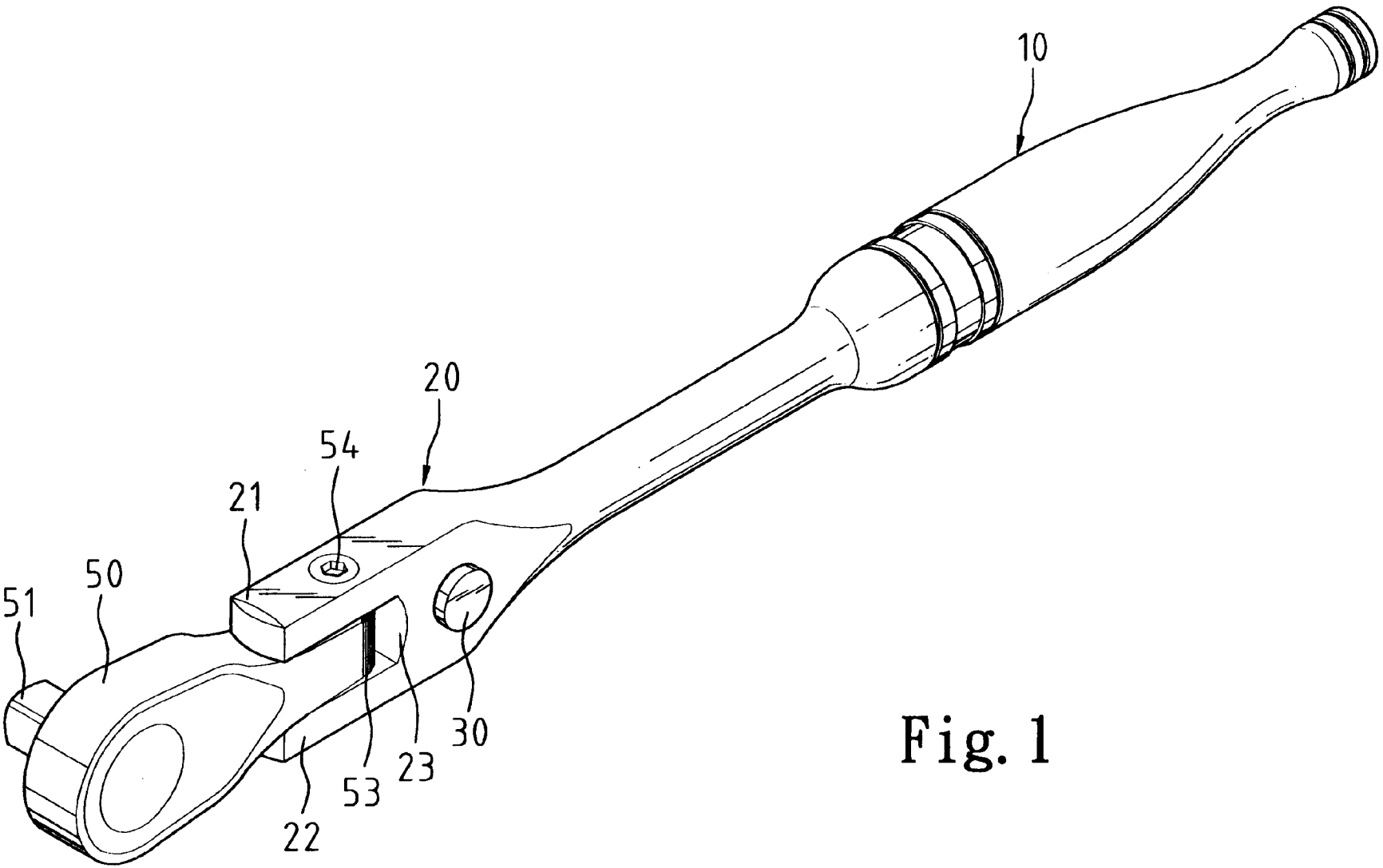
FIG. 1 is a perspective view of a ratcheting tool in accordance with the present invention.
Figure 2:
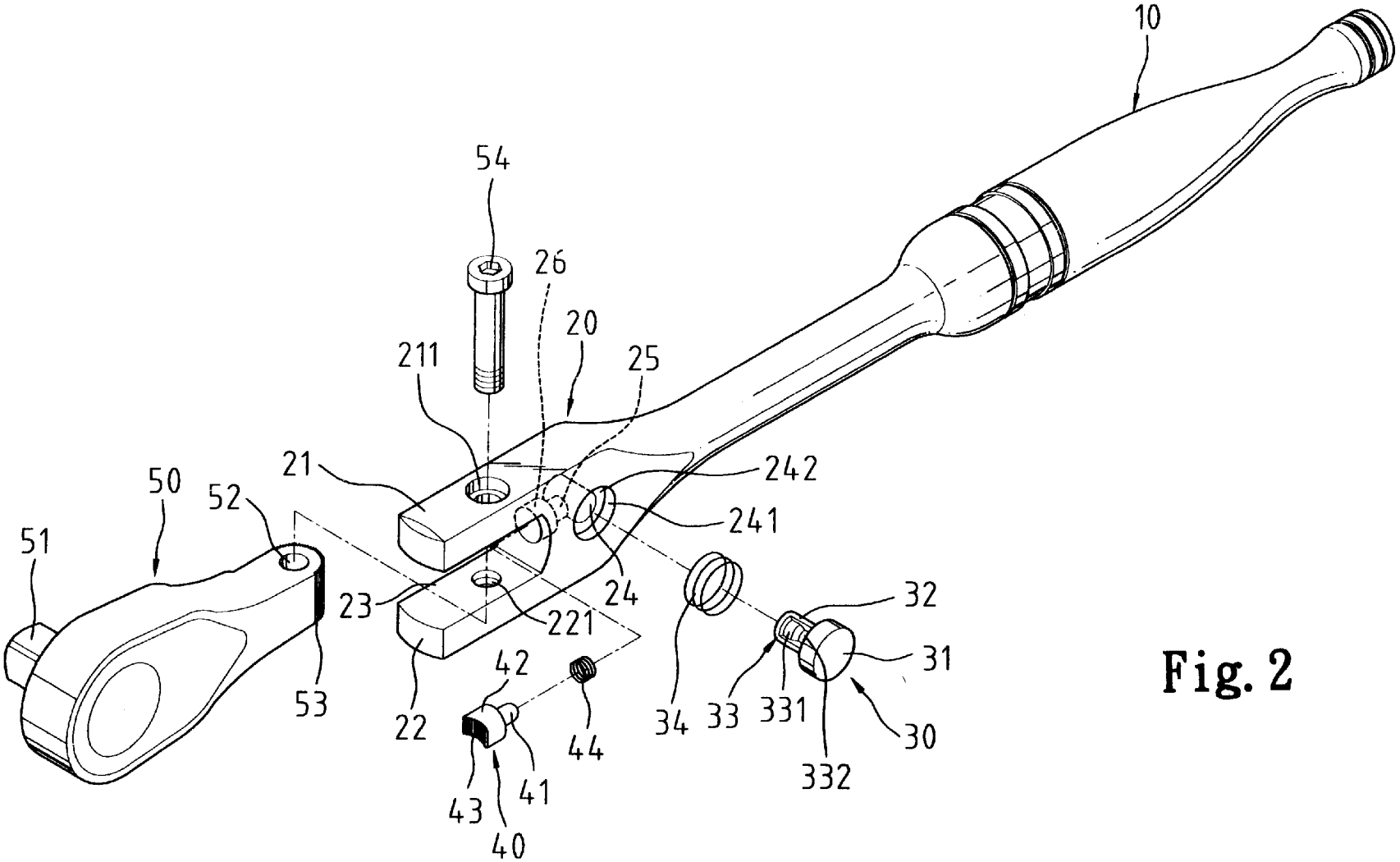
FIG. 2 is an exploded perspective view of the ratcheting tool in accordance with the present invention.

Referring to FIGS. 1 through 13 and initially to FIGS. 1 and 2, a ratcheting tool in accordance with the present invention generally includes a handle 10 and a head 50 adjustably connected to the handle 10. The head 50 includes a transverse hole 52 in a first end thereof and a drive column 51 extended from a second end thereof. The first end of the head 50 includes an arcuate toothed face with a plurality of teeth 53 formed thereon. The toothed arcuate face may extend for about 180°. It is appreciated that the head 50 may be a head of any kind of ratcheting tools, not limited to the socket wrench type ratcheting tool illustrated.

An end 20 of the handle 10 includes two walls 21 and 22 having a compartment 23 defined therebetween for receiving the first end of the head 50. A pin 54 is extended through aligned holes 211 and 221 (hole 221 is a screw hole) of the walls 21 and 22 of the end 20 of the handle 10 and through the transverse hole 52 in the head 50. A longitudinal hole 26 and a transverse hole 24 are defined in the handle 10, wherein an outer end of the longitudinal hole 26 communicates with the compartment 23 and the transverse hole 27 is communicated with an inner end of the longitudinal hole 26 via a reduced hole 25. A countersink 241 is defined in an end of the transverse hole 27 and defines an end wall 242.

A push button 30 includes a button head 31 and a stem 32 extended from the button head 31. The stem 32 is extended through the transverse hole 24 and has a supporting portion 33 including a first supporting face 331 and a second supporting face 332 that is lower than the first supporting face 331. The first supporting face 331 is inclined, which will be described later. An elastic member (e.g., a spring 34) is mounted around the stem 32 and located in the countersink 241, as shown in FIG. 3A. The spring 34 is thus attached between the end wall 242 and the button head 31 to bias the push button 30 outward.

A catch 40 and an elastic member (e.g., a spring 44) are mounted in the longitudinal hole 26 for releasably engaging with the teeth 53 of the head 50. As illustrated in FIGS. 2 and 3A, the catch 40 includes a body 42 with an arcuate toothed surface 43 formed on a first end thereof and a stub 41 projected from a second end thereof. The spring 44 is mounted around the stub 41 that extends through the reduced hole 25 and rests on the stem 32 of the push button 30.

Figure 3:
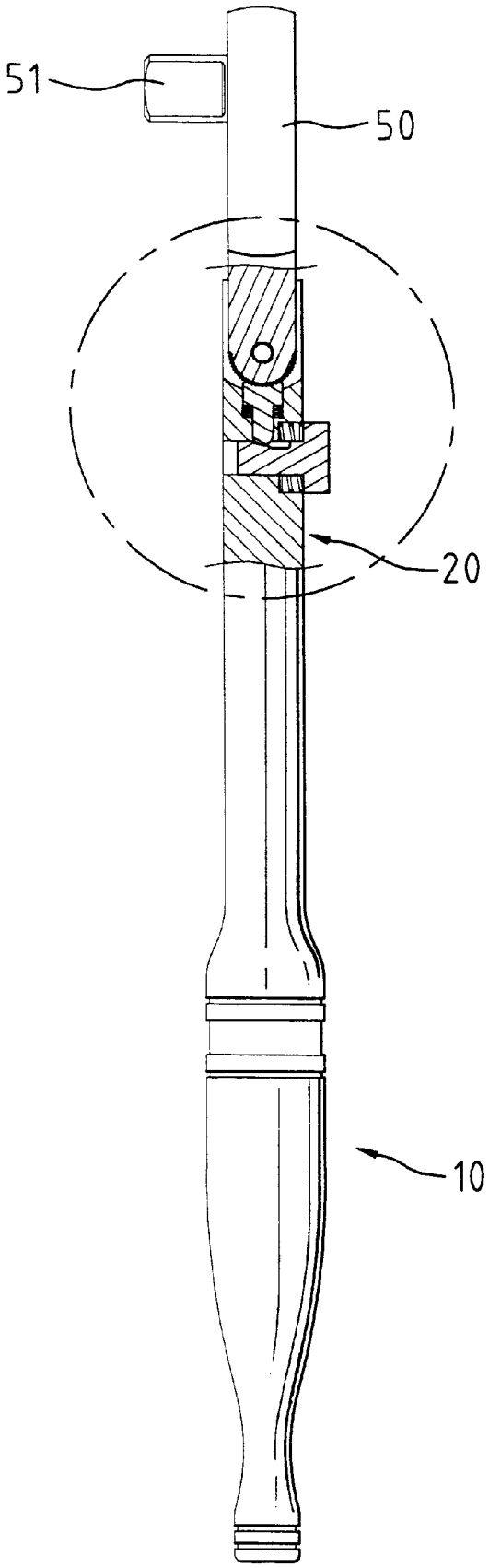
FIG. 3 is a side view, partly sectioned, of the ratcheting tool in accordance with the present invention.
Figure 3A:
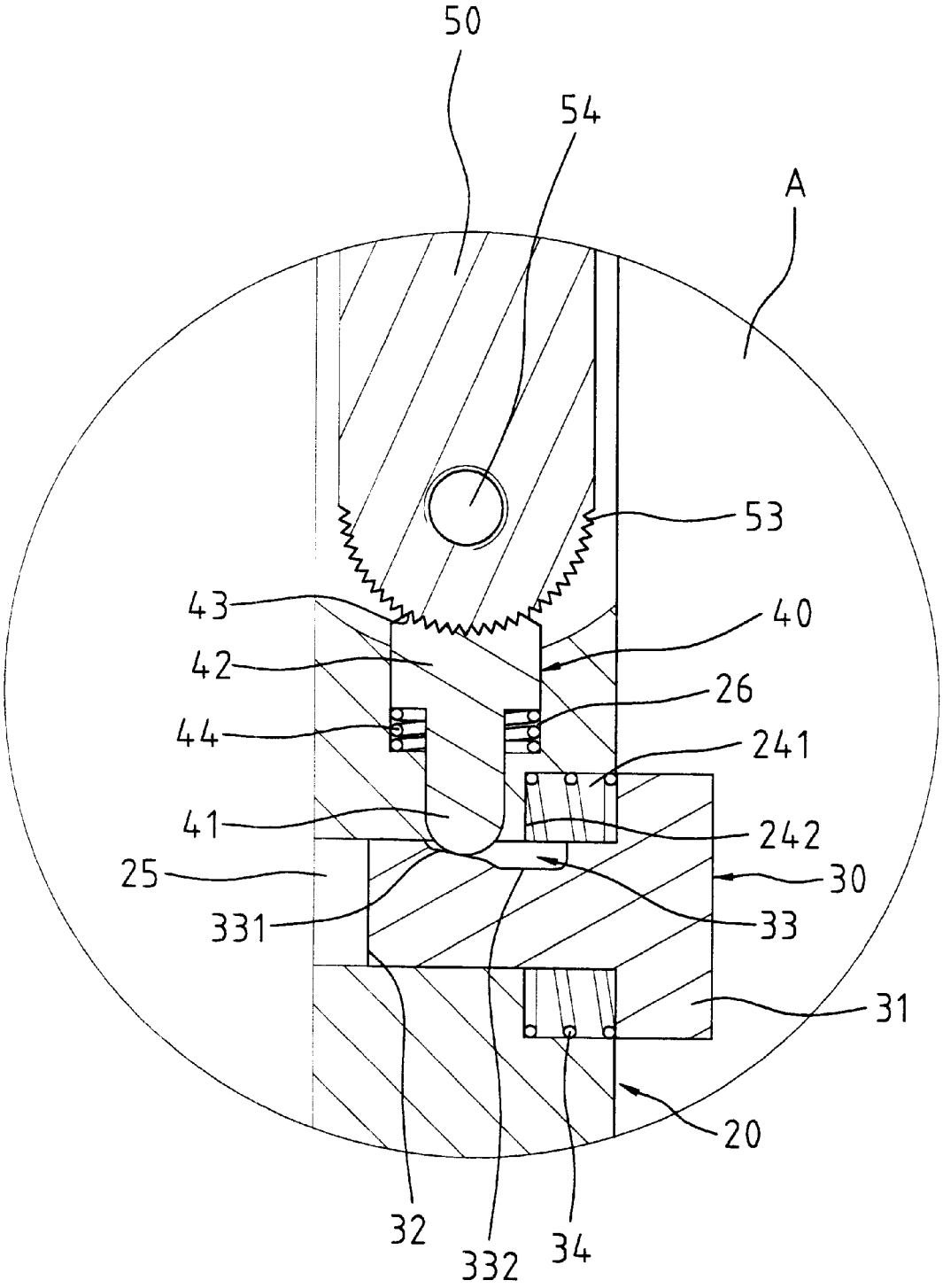
FIG. 3A is an enlarged view of a circle A in FIG. 3.

When the push button 30 is in a released position shown in FIGS. 3 and 3A, the stub 41 of the catch 40 rests on the first supporting face 331 of the stem 32 of the push button 30, and the spring 44 biases the arcuate toothed surface 43 of the catch 40 to engage with the arcuate teeth 53 of the head 50, thereby retaining the head 50 in a desired angular position with respect to the handle 10. The teeth 53 of the head 50 may be engaged with the arcuate toothed surface of the catch 40 by more than ten teeth to thereby provide a reliable retaining effect.

Figure 4:
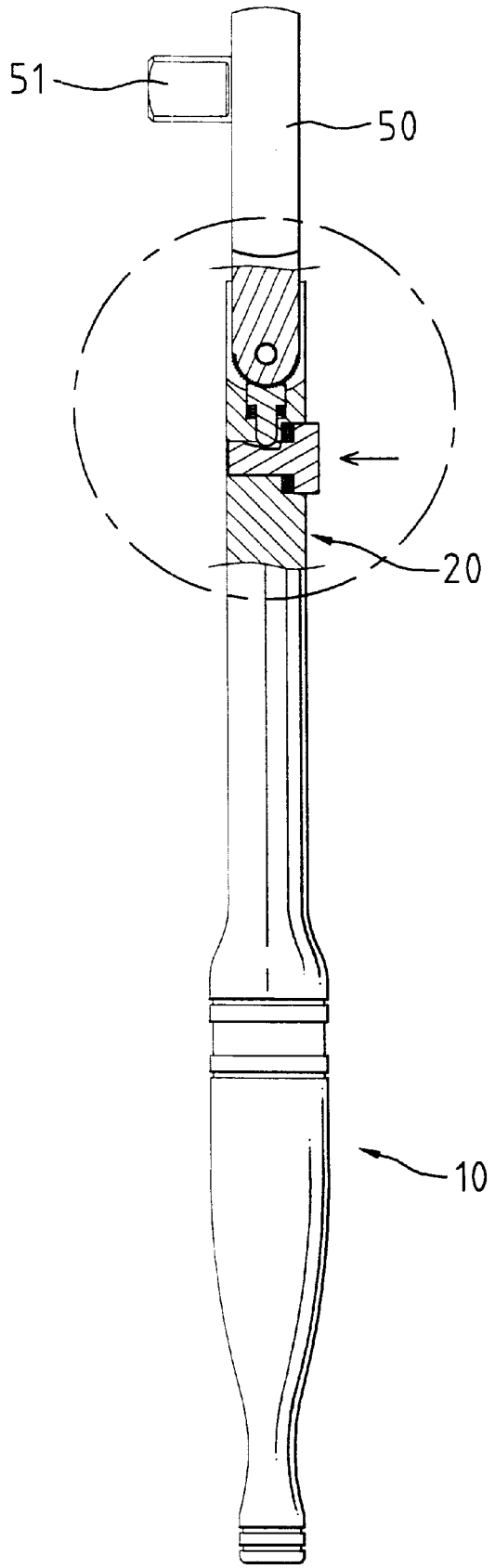
FIG. 4 is a view similar to FIG. 3, wherein a push button is pushed.
Figure 4A:
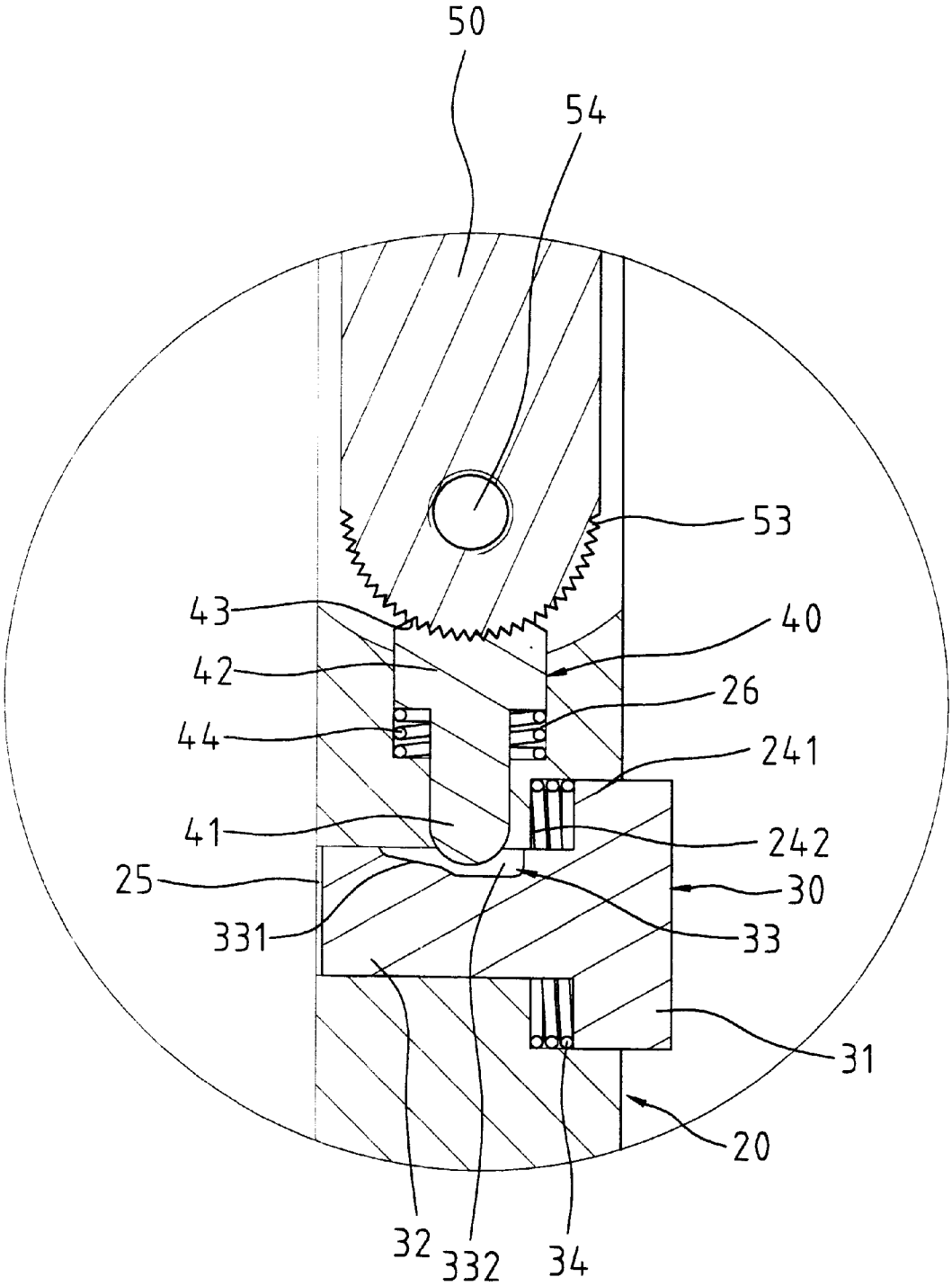
FIG. 4A is an enlarged view of a circle B in FIG. 4.

Referring to FIGS. 4 and 4A, when the push button 30 is pushed inward, the stub 41 of the catch 40 disengages from the first supporting face 331 and not engaged with the second supporting face 332 of the push button 30. Thus, the head 50 is pivotable relative to the handle 10.

Figure 5:
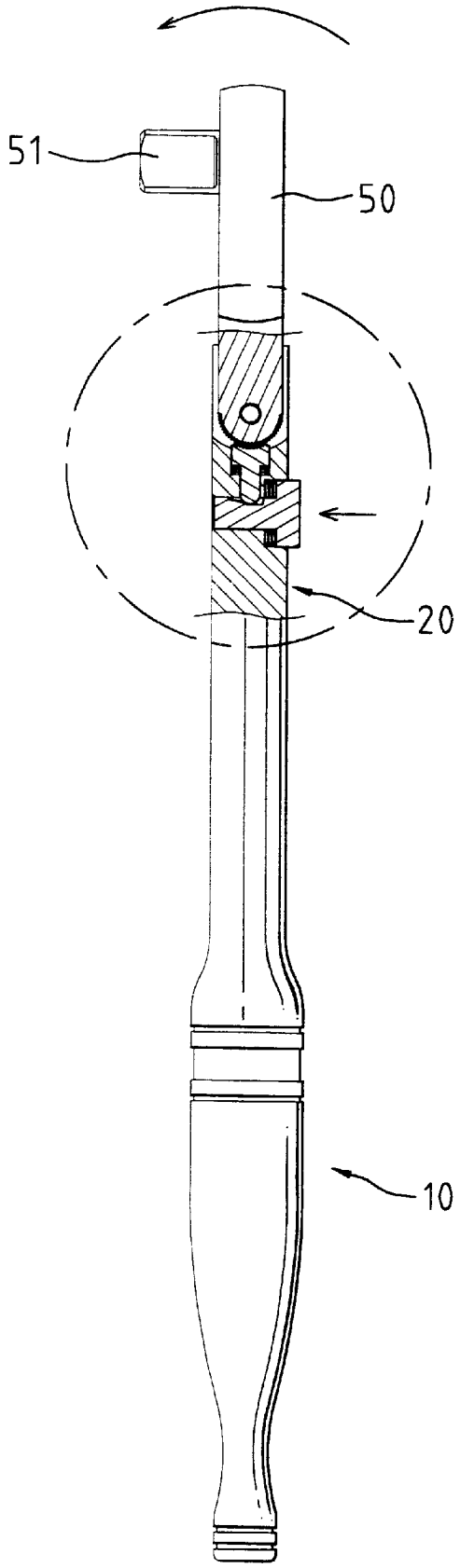
FIG. 5 is a view similar to FIG. 4, wherein a head is pivoted through a small angle.
Figure 5A:
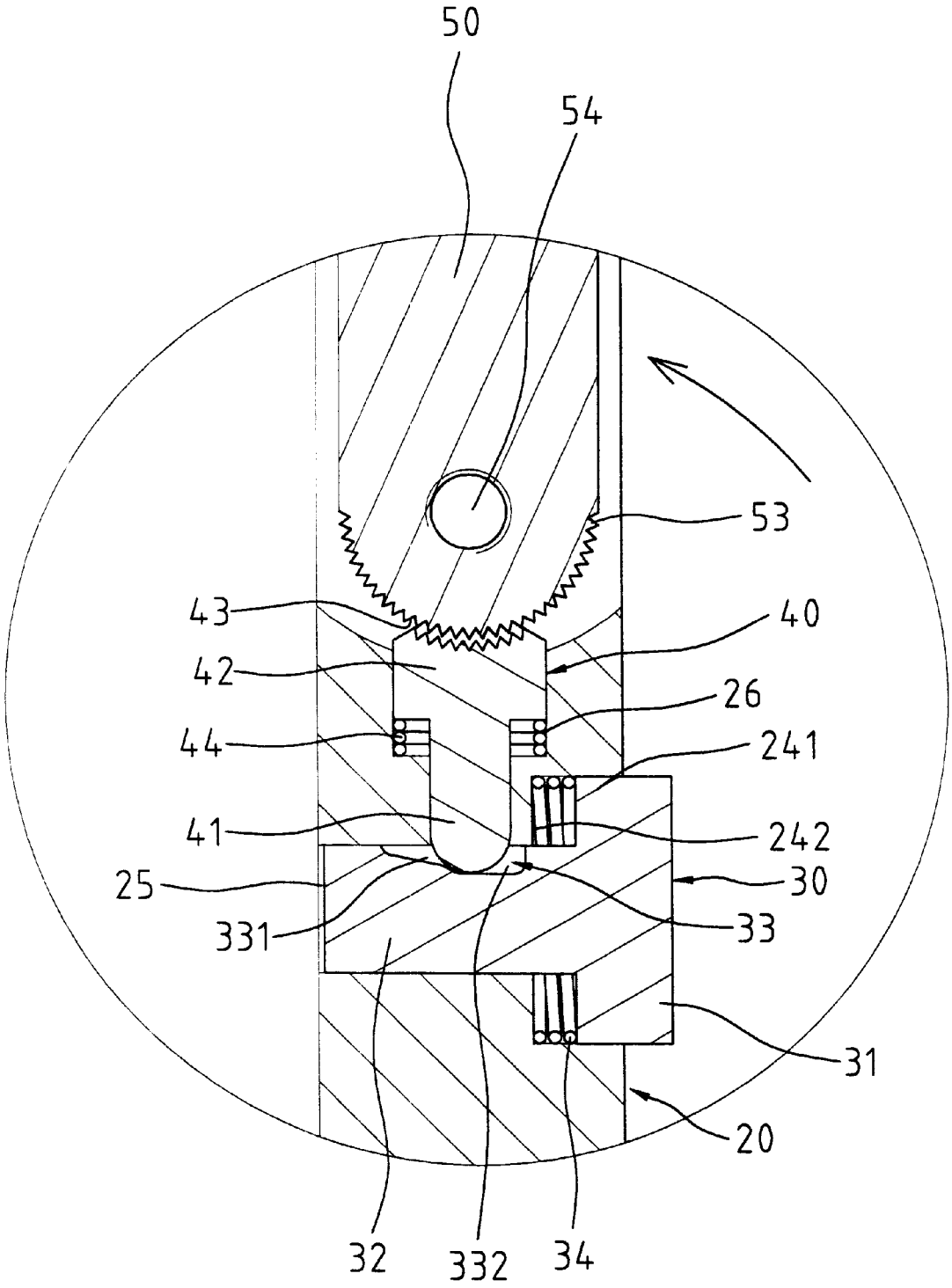
FIG. 5A is an enlarged view of a circle C in FIG. 5.
Figure 6:
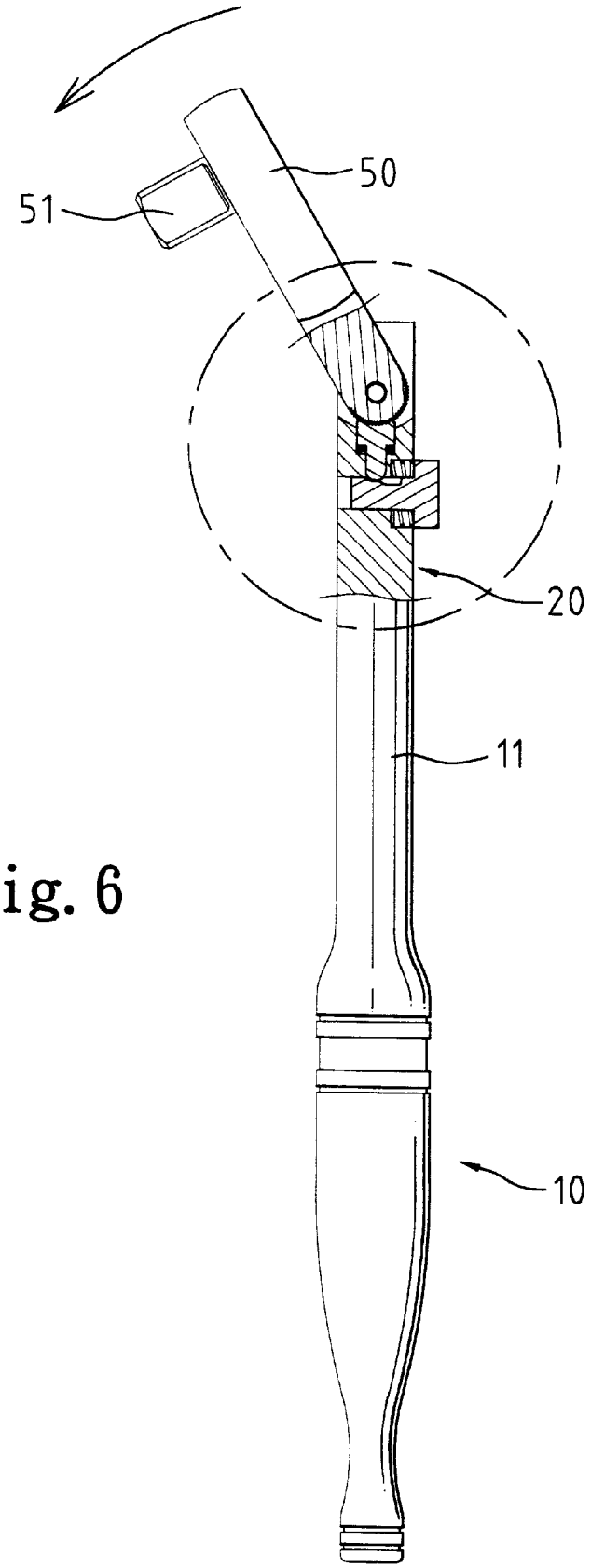
FIG. 6 is a view similar to FIG. 5, wherein the head is pivoted through a larger angle.
Figure 6A:
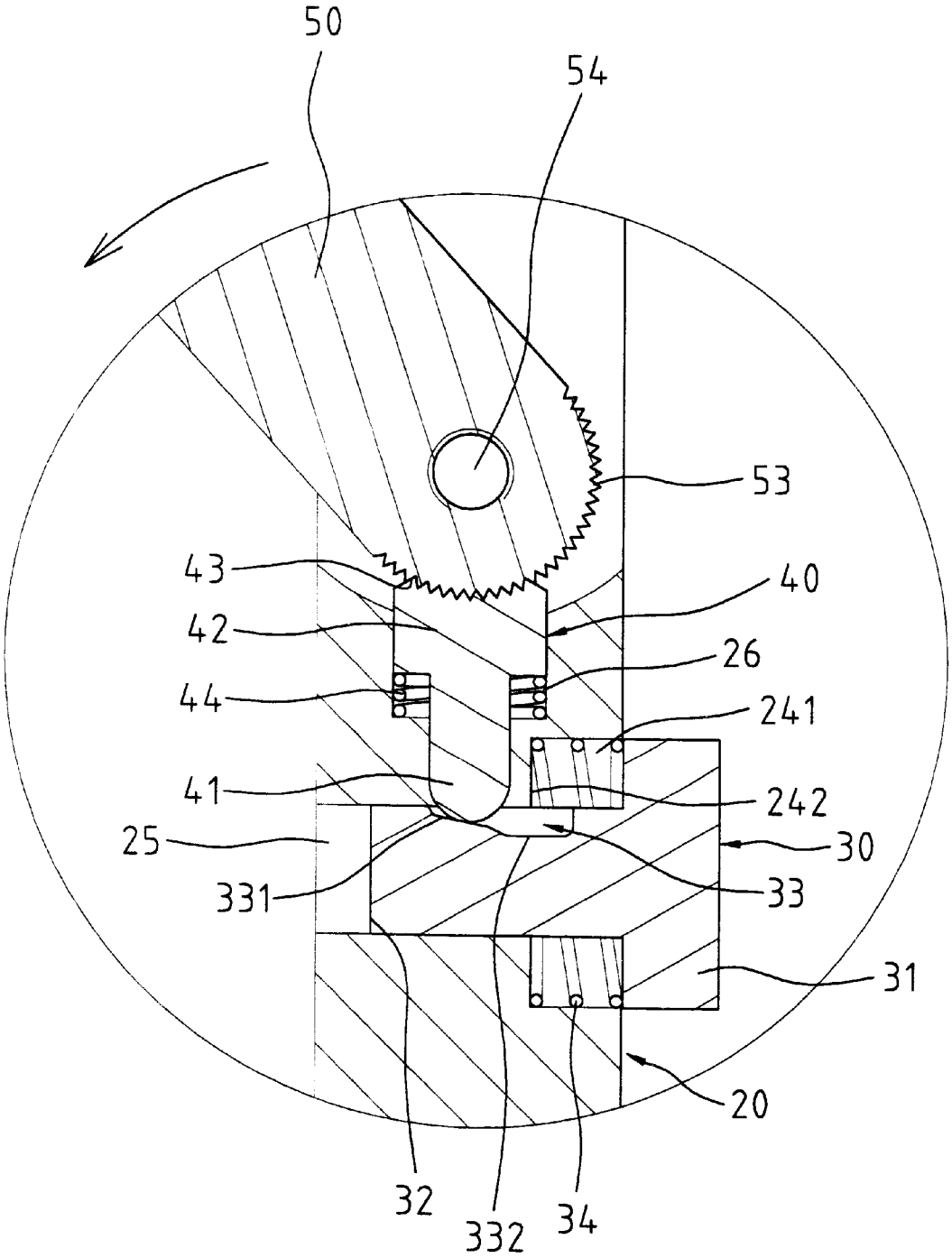
FIG. 6A is an enlarged view of a circle D in FIG. 6.
Figure 7:
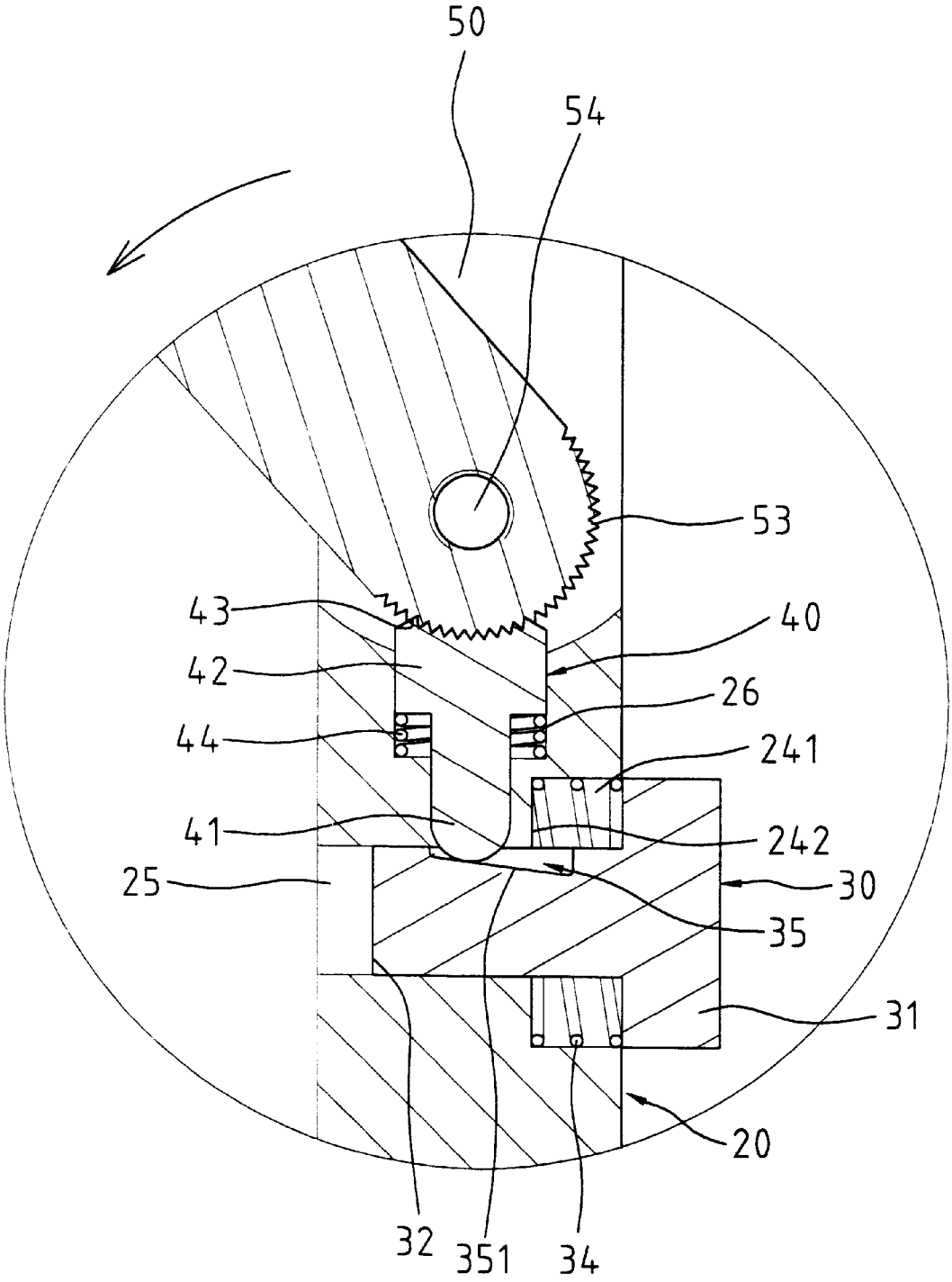
FIG. 7 is a view similar to FIG. 6A, illustrating a modified embodiment of the push button.

Referring to FIGS. 5 and 5A, when adjustment of the angular position of the head 50 is required, the head 50 is pivoted and thus causes disengagement of the toothed surface 43 of the catch 40 from the teeth 53 of the head 50. The stub 41 of the catch 40 now rests on the second supporting face 332. Namely, the head 50 is in free rotation during adjustment. Referring to FIGS. 6 and 6A, the user may pivot the head 50 to a desired angular position relative to the handle 10 and then releases the push button 30. The head 50 is reliably retained in the desired angular position relative to the handle 10. The relative angular relationship between the head and the handle can be finely adjusted, as the arcuate toothed surface 43 of the catch 90 and the arcuate toothed face of the head 50 may include more teeth. FIG. 7 illustrates a modified embodiment of the push button 30, wherein the supporting portion (now designated by 35) of the stem 32 of the push button 30 is modified as an inclined surface 351.

Figure 8:
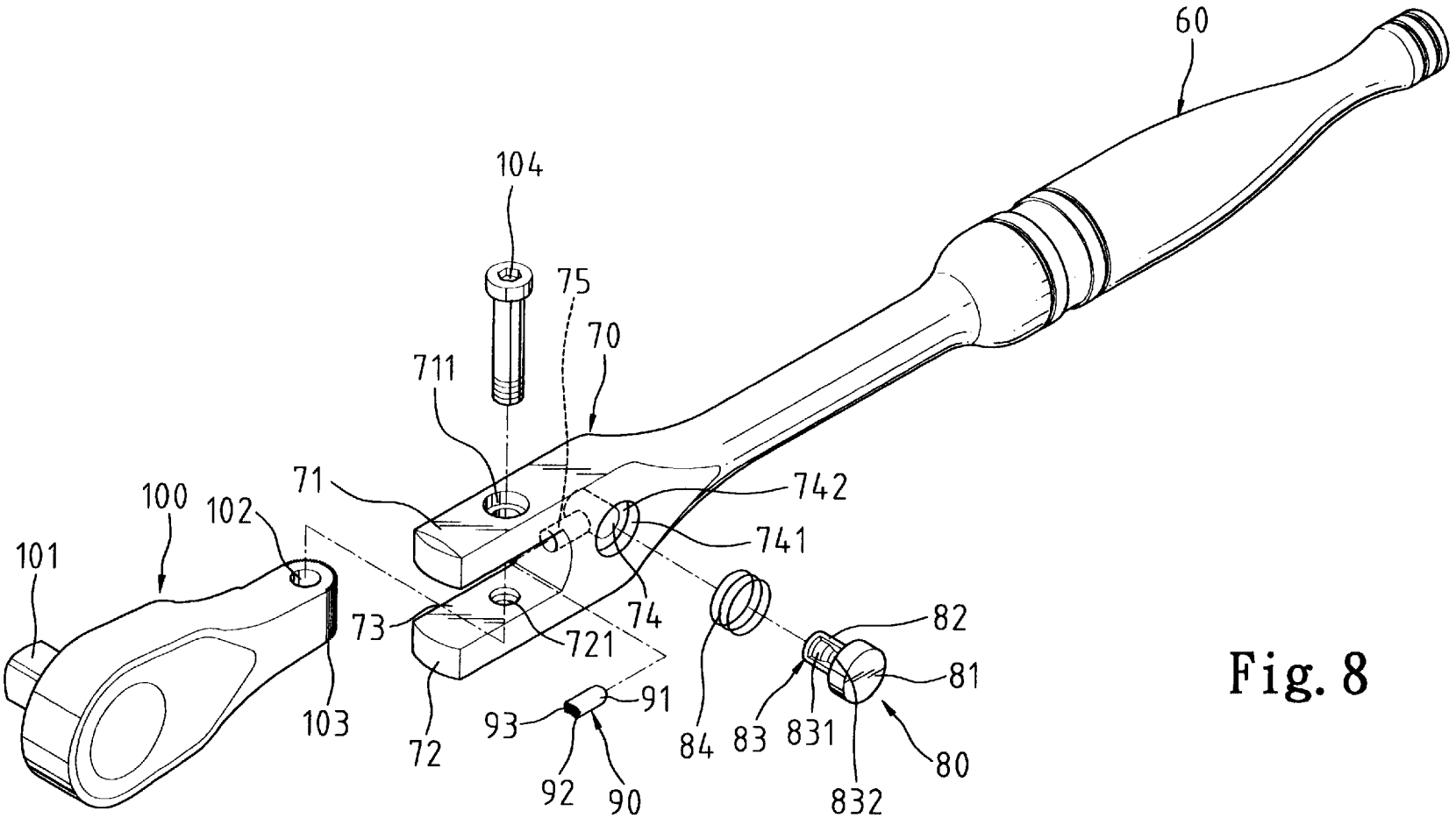
FIG. 8 is an exploded perspective view of a modified embodiment of the ratcheting tool in accordance with the present invention.

FIG. 8 illustrates a modified embodiment of the ratcheting tool in accordance with the present invention. The ratcheting tool includes a handle 60 and a head 100 adjustably connected to the handle 60. The head 100 includes a transverse hole 102 in a first end thereof and a drive column 101 extended from a second end thereof. The first end of the head 100 includes an arcuate toothed face with a plurality of teeth 103 formed thereon. The toothed arcuate face may extend for about 180°.

An end 70 of the handle 60 includes two walls 71 and 72 having a compartment 73 defined therebetween for receiving the first end of the head 100. A pin 104 is extended through aligned holes 711 and 721 (hole 721 is a screw hole) of the walls 71 and 72 of the end 70 of the handle 60 and through the transverse hole 102 in the head 100. A longitudinal hole 75 and a transverse hole 74 are defined in the handle 60, wherein an outer end of the longitudinal hole 75 communicates with the compartment 73 and the transverse hole 74 is communicated with an inner end of the longitudinal hole 75. A countersink 741 is defined in an end of the transverse hole 74 and defines an end wall 742.

Figure 9:
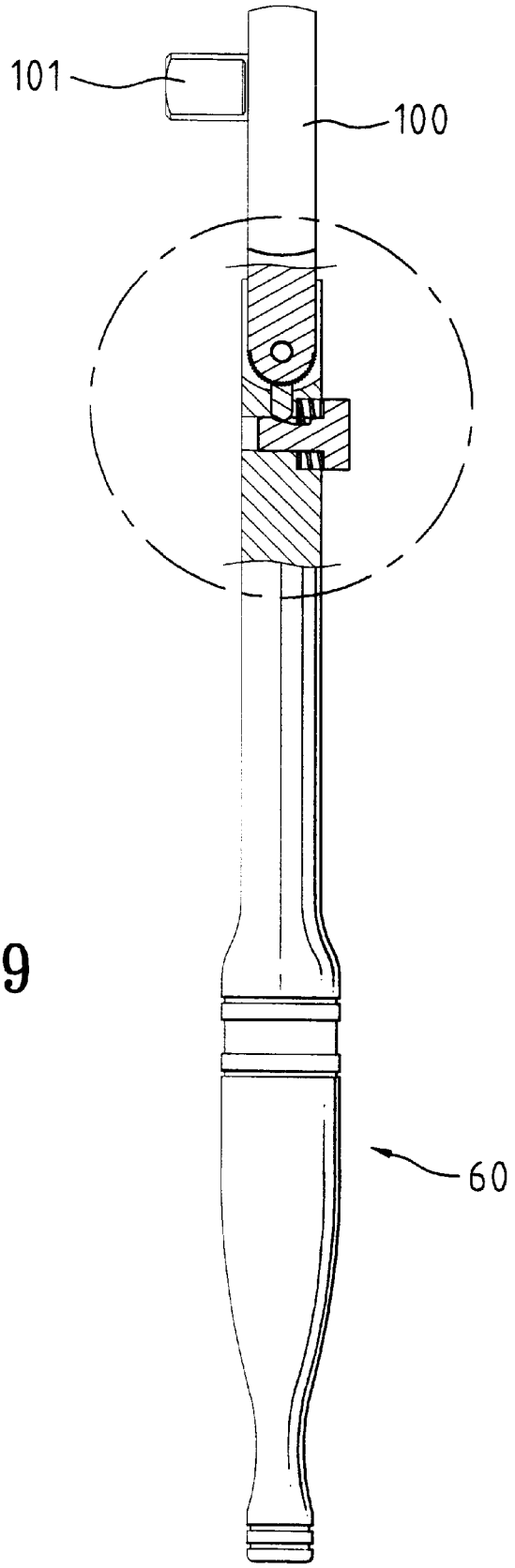
FIG. 9 is a side view, partly sectioned, of the ratcheting tool in FIG. 8.
Figure 9A:
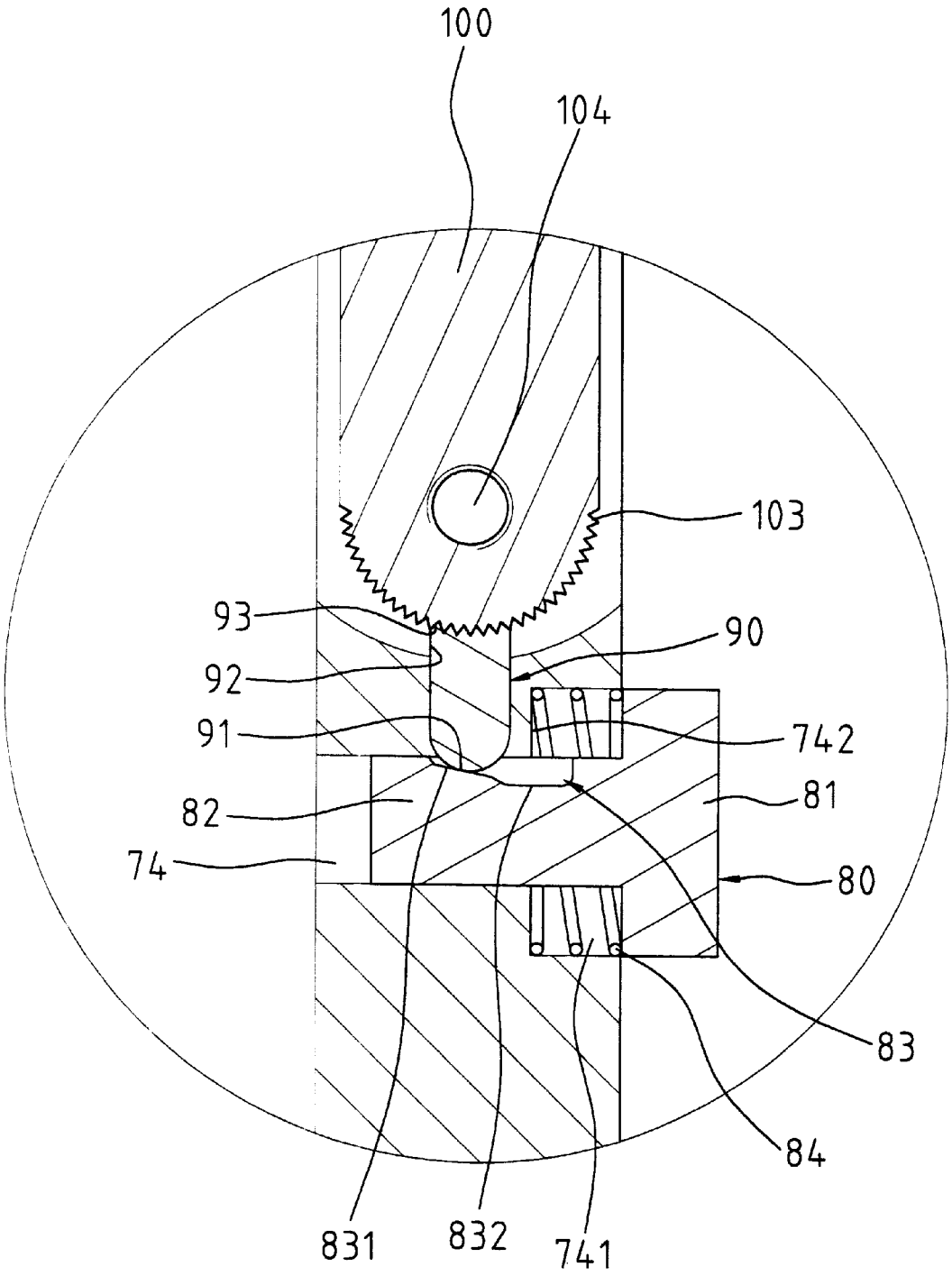
FIG. 9A is an enlarged view of a circle E in FIG. 9.

A push button 80 includes a button head 81 and a stem 82 extended from the button head 81. The stem 82 is extended through the transverse hole 74 and has a supporting portion 83 including a first supporting face 831 and a second supporting face 832 that is lower than the first supporting face 831. The first supporting face 831 is inclined, which will be described later. An elastic member (e.g., a spring 84) is mounted around the stem 82 and located in the countersink 841, as shown in FIG. 9A. The spring 84 is thus attached between the end wall 742 and the button head 81 to bias the push button 80 outward.

A catch 90 is mounted in the longitudinal hole 75 for releasably engaging with the teeth 103 of the head 100. As illustrated in FIGS. 8 and 9A, the catch 90 includes a first end 92 with an arcuate toothed surface 93 formed thereon and a second end 91.

When the push button 80 is in a released position shown in FIG. 9A, the first end 91 of the catch 90 rests on the first supporting face 831 of the stem 82 of the push button 80. The arcuate toothed surface 93 of the catch 90 is biased toward the head 100 to engage with the arcuate teeth 103 of the head 100, thereby retaining the head 100 in a desired angular position with respect to the handle 60. The teeth 103 of the head 100 may be engaged with the toothed surface 93 of the catch 90 by more than ten teeth to thereby provide a reliable retaining effect.

Figure 10:
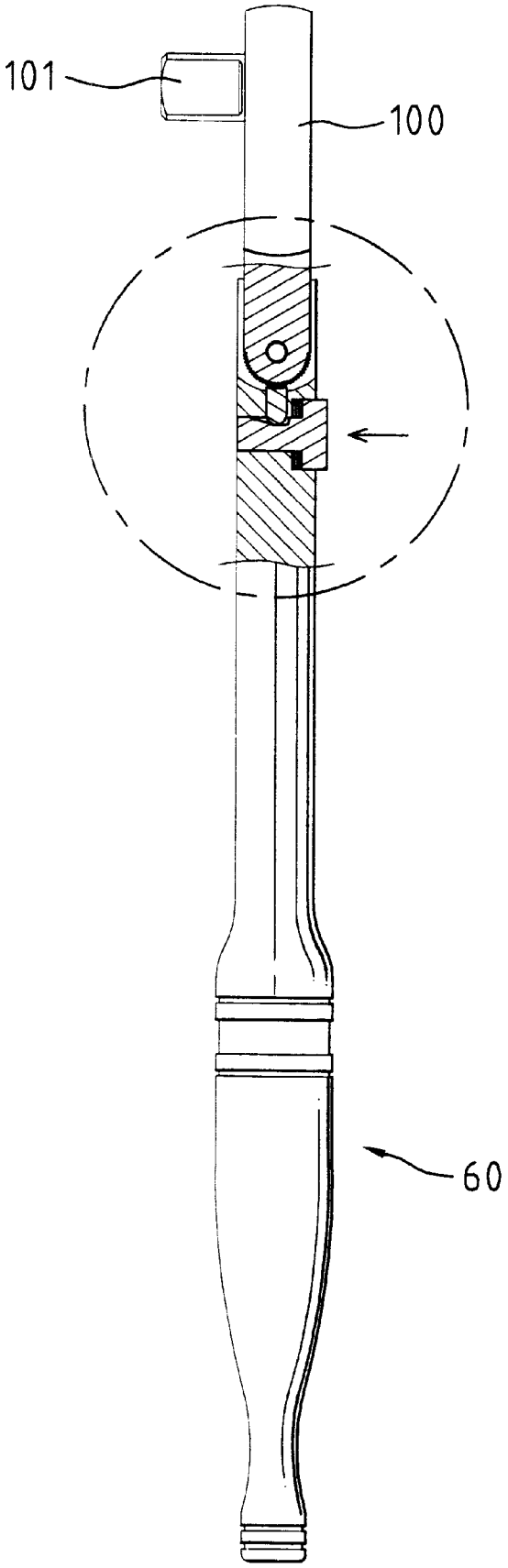
FIG. 10 is a view similar to FIG. 9, wherein a push button is pushed.
Figure 10A:
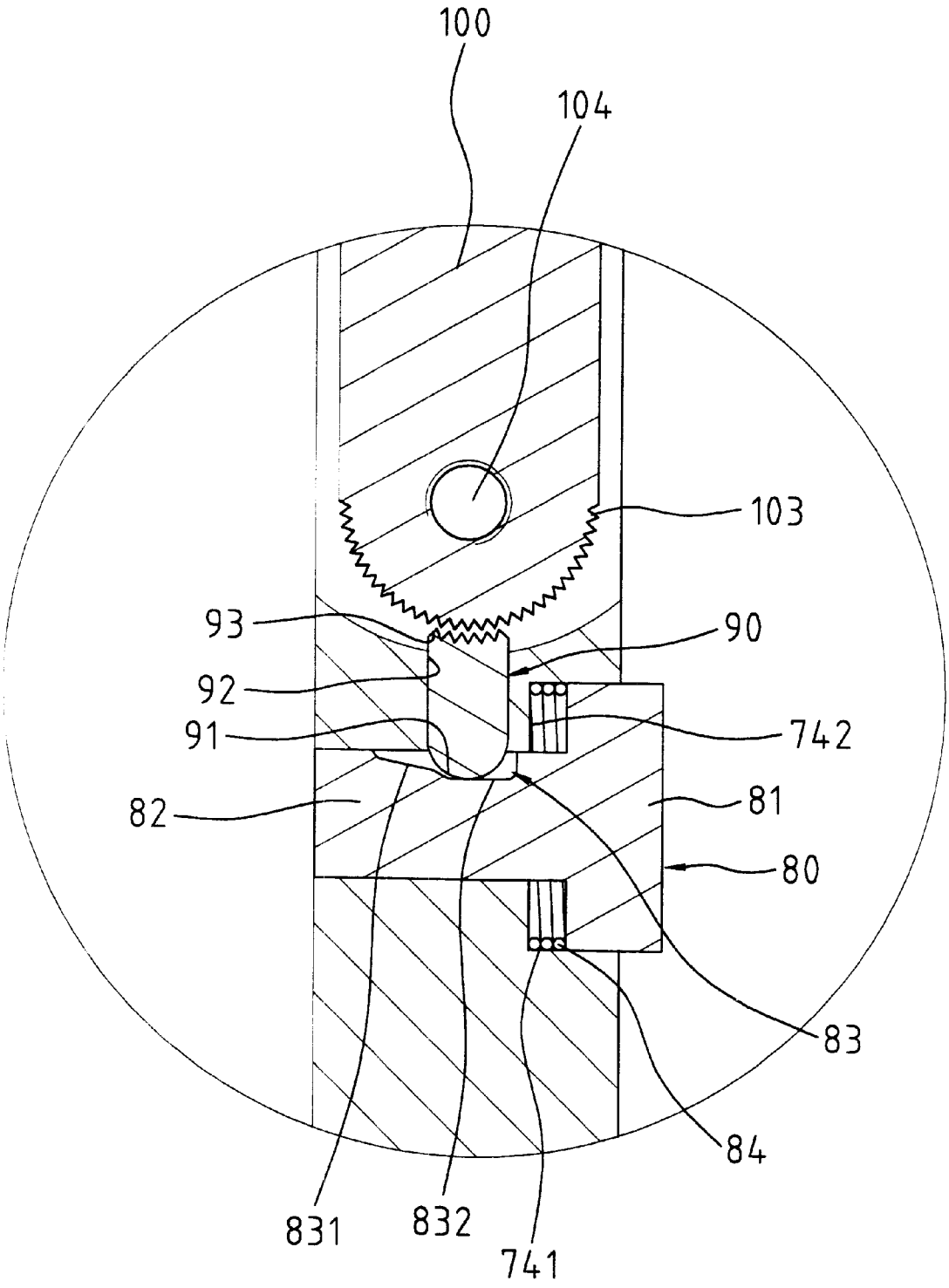
FIG. 10A is an enlarged view of a circle F in FIG. 10.
Figure 11:
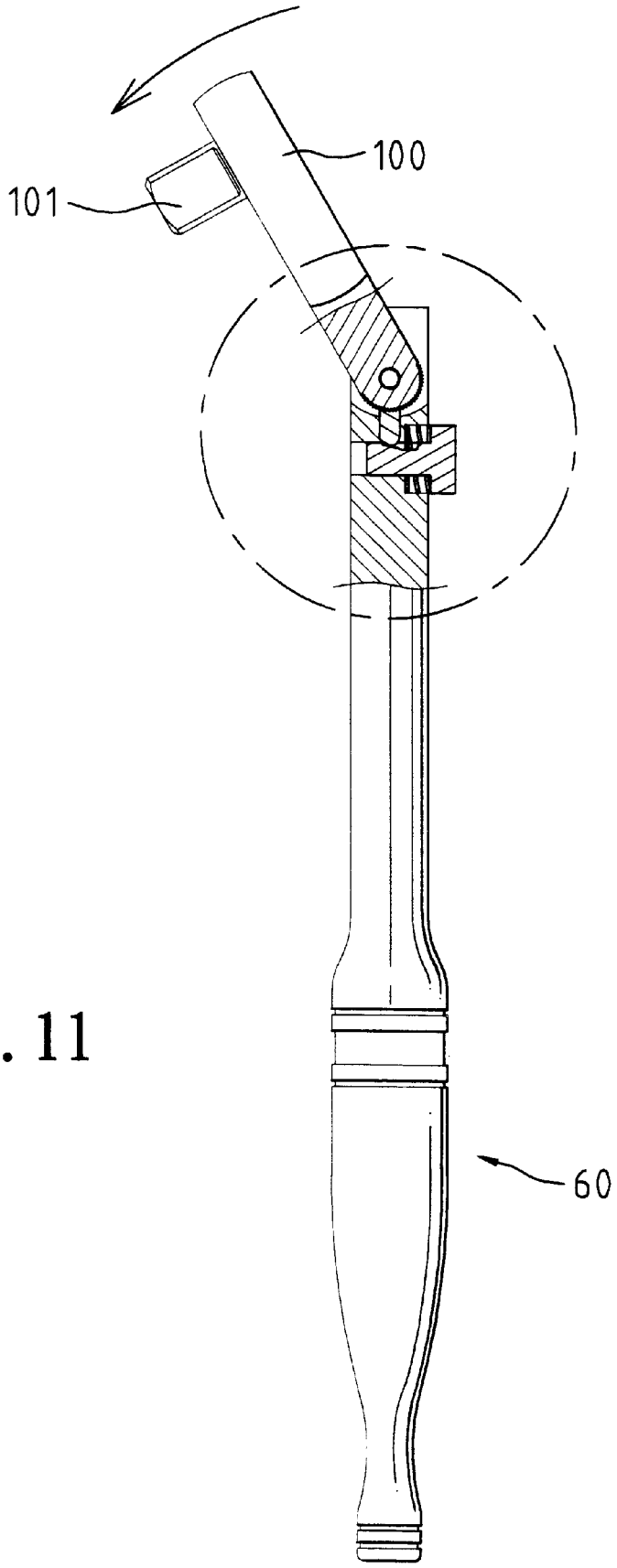
FIG. 11 is a view similar to FIG. 10, wherein the head is pivoted through an angle and the push button is released.
Figure 11A:
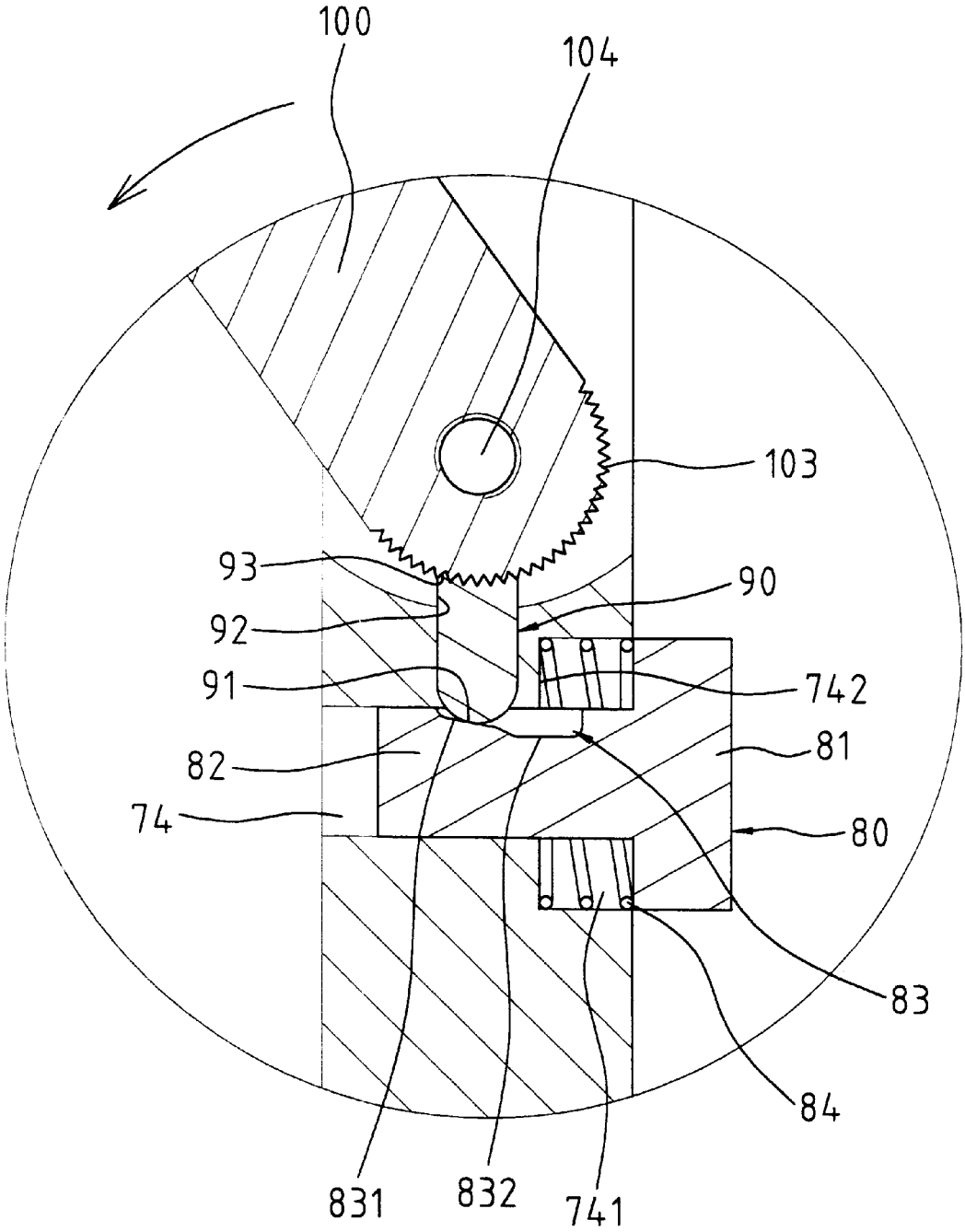
FIG. 11A is an enlarged view of a circle G in FIG. 10.

Referring to FIGS. 10 and 10A, when the push button 80 is pushed inward, the arcuate toothed surface 93 of the catch 90 disengages from the teeth 103 of the head 100 with the first end 91 of the catch 90 resting on the second supporting face 832 of the push button 80. Thus, the head 100 is pivotable relative to the handle 60. Referring to FIGS. 11 and 11A, when adjustment of the angular position of the head 100 is required, the head 100 is pivoted to a desired angular position relative to the handle 60 and the push button 80 is then released. The head 100 is reliably retained in the desired angular position relative to the handle 60. The relative angular relationship between the head and the handle can be finely adjusted, as the arcuate toothed surface 93 of the catch 90 of the arcuate toothed face of the head 100 may include more teeth.

Figure 12:
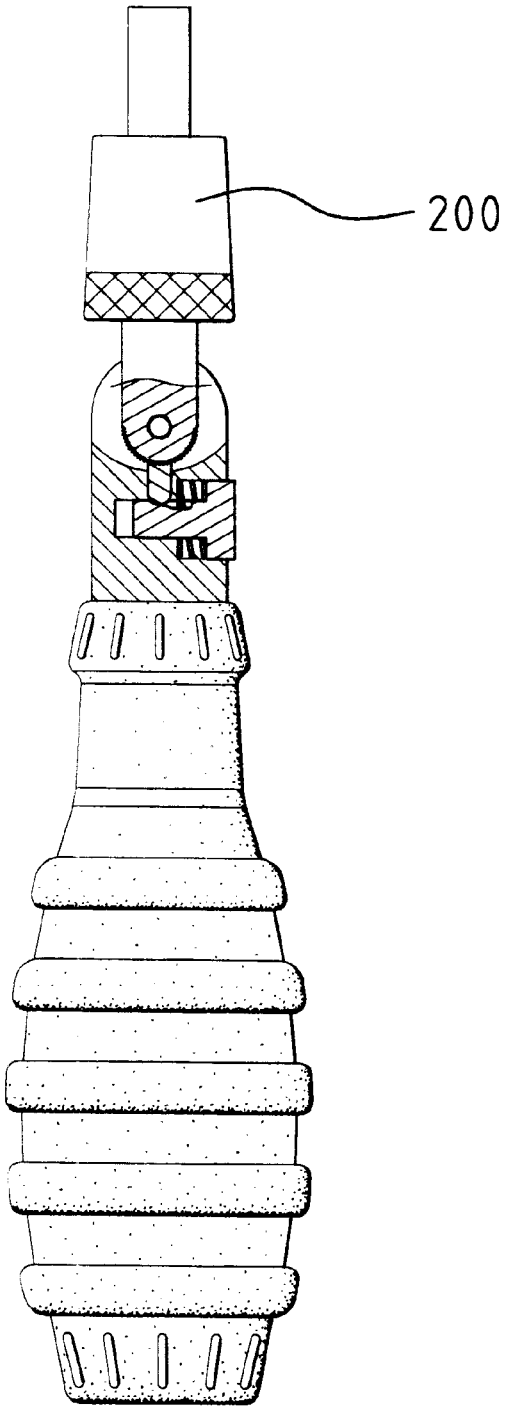
FIG. 12 is a side view, partly sectioned, illustrating application of the ratcheting tool in accordance with the present invention to a tool bit connector.
Figure 13:
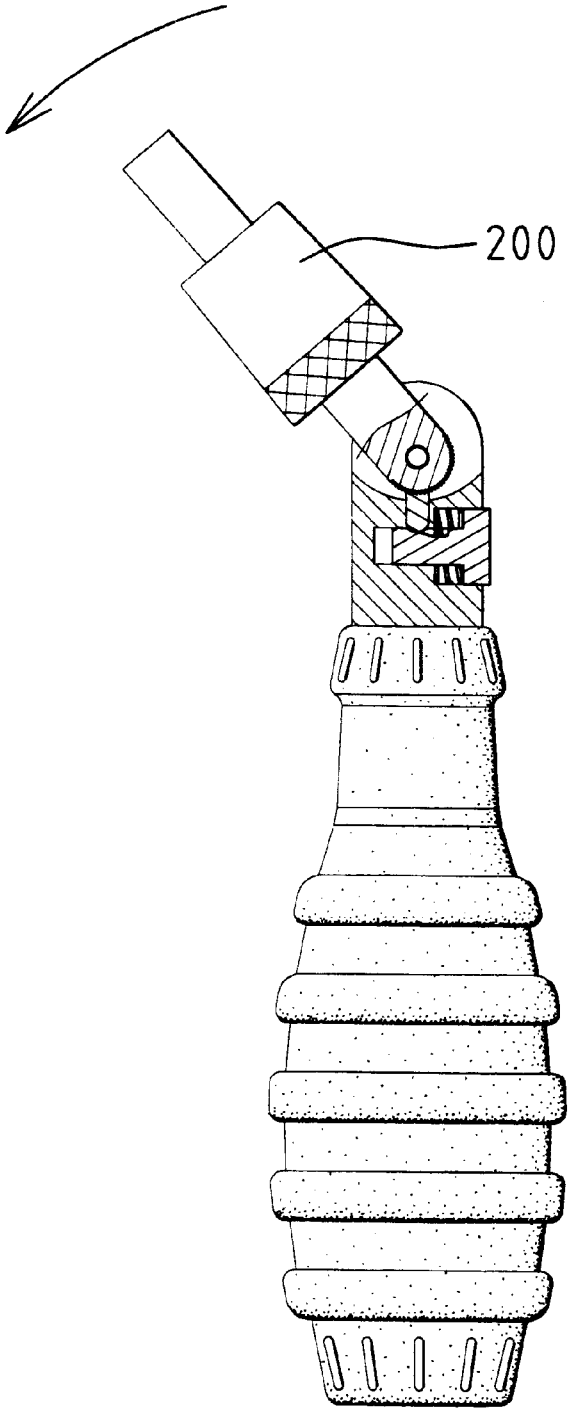
FIG. 13 is a view similar to FIG. 12, wherein a head is adjusted to a desired angular position.
Figure 14:
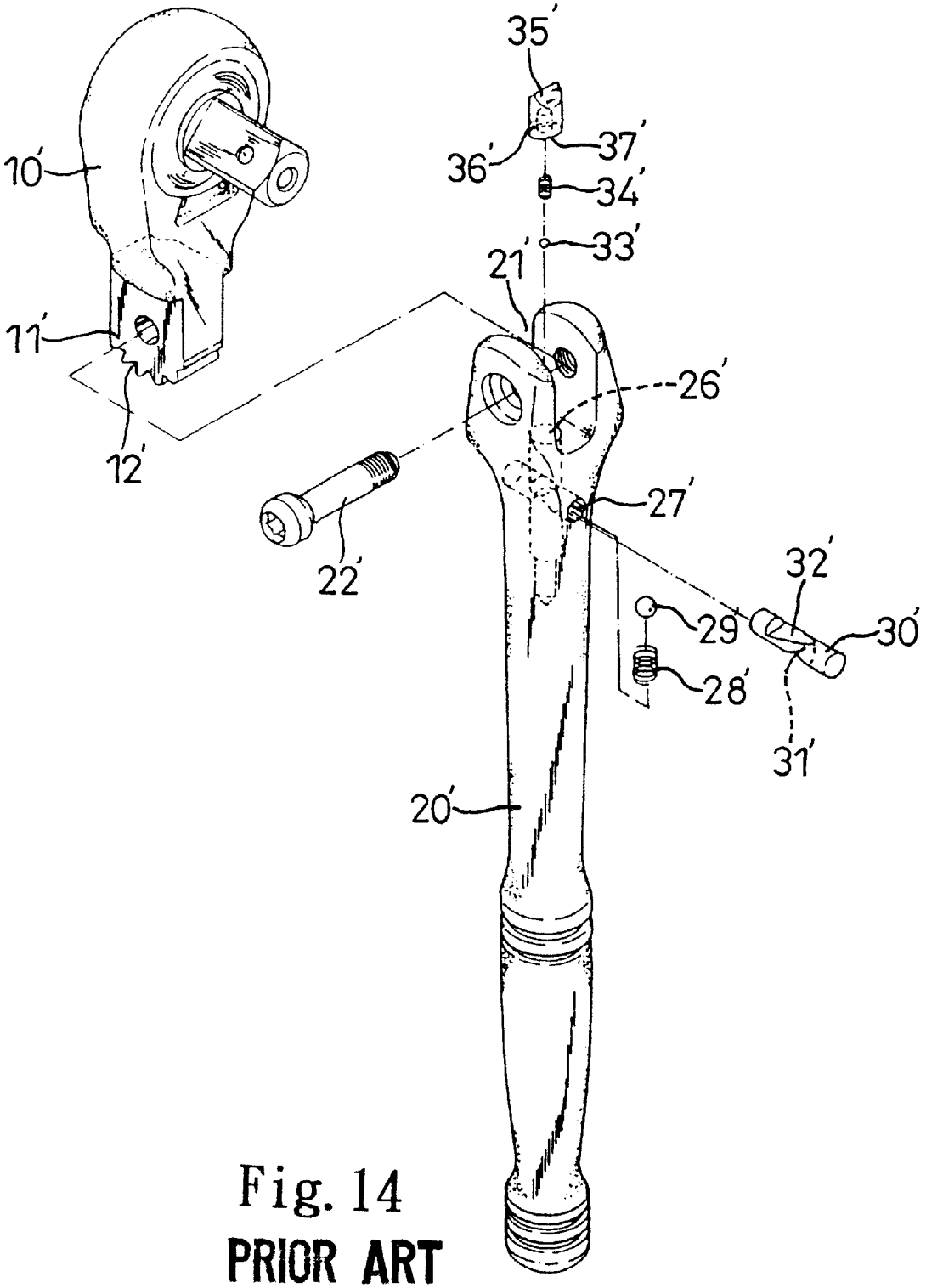
Fig. 14 PRIOR ART
FIG. 14 is an exploded perspective view of a conventional ratcheting tool with an adjustable head.
Figure 15:
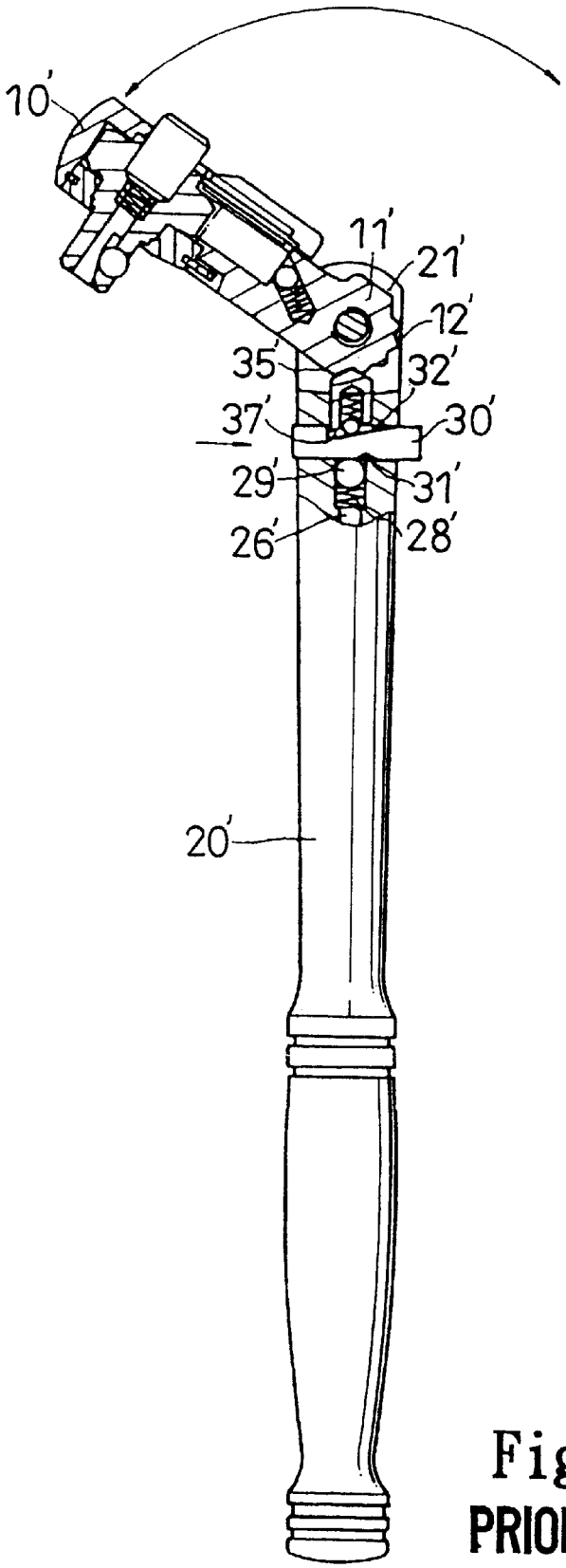
Fig. 15 PRIOR ART
FIG. 15 is a side view, partly sectioned, of the ratcheting tool in FIG. 14.
Figure 16:
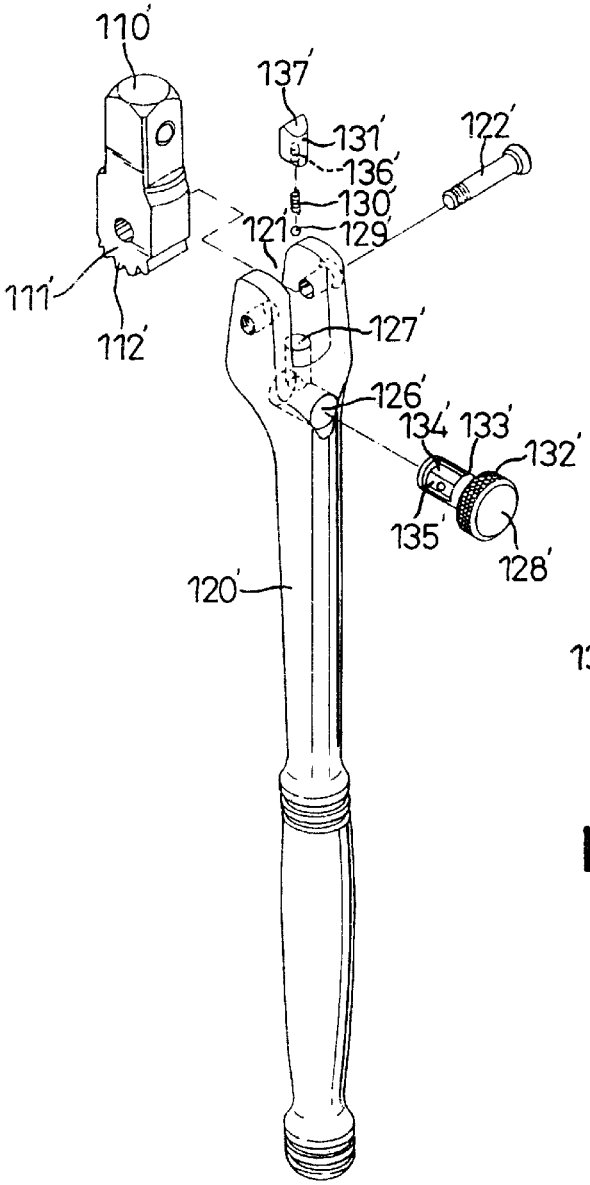
Fig. 16 PRIOR ART
FIG. 16 is an exploded perspective view of another conventional ratcheting tool with an adjustable head.
Figure 18:
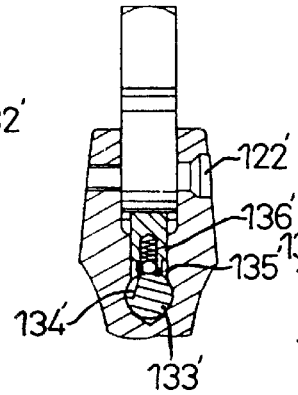
Fig. 18 PRIOR ART
FIG. 18 is a sectional view taken along line 18—18 in FIG. 17.
Figure 17:
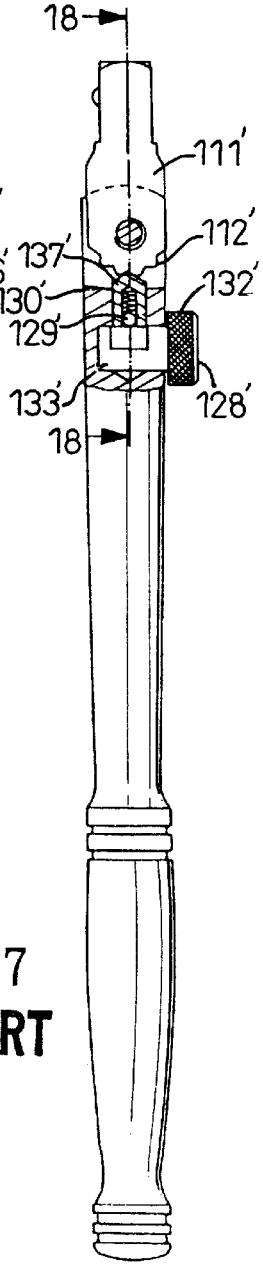
Fig. 17 PRIOR ART
FIG. 17 is a side view, partly sectioned, of the ratcheting tool in FIG. 16.

FIGS. 12 and 13 illustrate application of the adjustment arrangement to a tool bit connector 200. The tool bit connector 200 may engage with any kind of screwdrivers, sockets, or hex wrenches.

According to the above description, it is appreciated that the head of the ratcheting tool in accordance with the present invention may by adjusted to a desired angular position relative to the handle in an easier manner. The overall structure is simple for reducing potential malfunction possibility and is easy to manufacture and assemble. The head is reliably retained in place, and the relative angular relationship between the head and the handle can be finely adjusted.

Although the invention has been explained in relation to its preferred embodiment, it is to be understood that many other possible modifications and variations can be made without departing from the spirit and scope of the invention as hereinafter claimed.

What is claimed is:

1. A ratcheting tool comprising:

a head including an end with an arcuate toothed face;

a handle including an end defining a compartment for pivotal connection with the end of the head, the handle including a longitudinal hole having an inner end and an outer end communicated with the compartment, the handle further including a transverse hole communicated with the inner end of the longitudinal hole and a reduced hole intercommunicated between the transverse hole and the inner end of the longitudinal hole;

a catch mounted in the longitudinal hole and including a first end with an arcuate toothed surface and a second end including a stub extended through the reduced hole;

a push button mounted in the transverse hole and including a stem, the stem including a relatively higher portion and a relatively lower portion;

means for biasing the push button to a retaining position in which the second end of the catch engages with the relatively higher portion of the stem such that the arcuate toothed surface of the catch is biased to engage with the arcuate toothed face of the head, thereby retaining the head in an angular position relative to the handle, and wherein when the push button is pushed, the second end of the catch is disengaged from the relatively higher portion of the stem such that the arcuate toothed surface of the catch is disengaged from the arcuate toothed face of the head, thereby allowing adjustment of the angular position of the head relative to the handle; and an elastic member being mounted around the stub for assisting in bias of the catch toward the head when the push button is in its retaining position.

2. The ratcheting tool as claimed in claim 1, wherein the stem of the push button includes an inclined surface for engaging with the second end of the stem.

3. A ratcheting tool comprising:

a head including an end with an arcuate toothed face;

a handle including an end defining a compartment for pivotal connection with the end of the head, the handle including a longitudinal hole having an inner end and an outer end communicated with the compartment, the handle further including a transverse hole communicated with the inner end of the longitudinal hole, wherein the transverse hole includes a countersink in an end thereof to define an end wall;

a catch mounted in the longitudinal hole and including a first end with an arcuate toothed surface and a second end;

a push button mounted in the transverse hole and including a stem, the push button including a button head from which the stem extends, the stem including a relatively higher portion and a relatively lower portion; and means for biasing the push button to a retaining position in which the second end of the catch engages with the relatively higher portion of the stem such that the arcuate toothed surface of the catch is biased to engage with the arcuate toothed face of the head, thereby retaining the head in an angular position relative to the handle, and wherein when the push button is pushed, the second end of the catch is disengaged from the relatively higher portion of the stem such that the arcuate toothed surface of the catch is disengaged from the arcuate toothed face of the head, thereby allowing adjustment of the angular position of the head relative to the handle, the biasing means being an elastic member mounted around the stem, located in the countersink, and attached between the end wall and the button head.

4. The ratcheting tool as claimed in claim 3, wherein the stem of the push button includes an inclined surface for engaging with the second end of the catch.

* * * * *

US006216567C1

(12) EX PARTE REEXAMINATION CERTIFICATE (8647th)

United States Patent

Hu

(10) Number: US 6,216,567 C1

(45) Certificate Issued: Nov. 1, 2011

(54) RATCHETING TOOLS HAVING AN ANGLE-ADJUSTABLE HEAD

(76) Inventor: Bobby Hu, Taichung (TW)

Reexamination Request:
No. 90/011,536, Mar. 7, 2011

Reexamination Certificate for:

| | |
|---|---|
| Patent No.: | **6,216,567** |
| Issued: | **Apr. 17, 2001** |
| Appl. No.: | **09/434,539** |
| Filed: | **Nov. 5, 1999** |

(51) Int. Cl.
*B25B 23/16* (2006.01)

(52) U.S. Cl. ..... 81/177.9; 81/177.7; 81/177.6

(58) Field of Classification Search ..... 81/177.6–177.9, 81/177.75, 177–85
See application file for complete search history.

(56) References Cited

To view the complete listing of prior art documents cited during the proceeding for Reexamination Control Number 90/011,536, please refer to the USPTO's public Patent Application Information Retrieval (PAIR) system under the Display References tab.

*Primary Examiner*—Jimmy G Foster

(57) ABSTRACT

A ratcheting tool includes a head including an end with an arcuate toothed face and a handle having an end defining a compartment for pivotal connection with the end of the head. The handle includes a longitudinal hole having an inner end and an outer end communicated with the compartment. The handle further includes a transverse hole communicated with the inner end of the longitudinal hole. A catch is mounted in the longitudinal hole and includes a first end with an arcuate toothed surface and a second end. A push button is mounted in the transverse hole and includes a stem, the stem including a relatively higher portion and a relatively lower portion. An elastic member biases the push button to a retaining position in which the second end of the catch engages with the relatively higher portion of the stem such that the arcuate toothed surface of the catch is biased to engage with the arcuate toothed face of the head, thereby retaining the head in an angular position relative to the handle. When the push button is pushed, the second end of the catch is disengaged from the relatively higher portion of the stem such that the arcuate toothed surface of the catch is disengaged from the arcuate toothed face of the head, thereby allowing adjustment of angular position of the head relative to the handle.

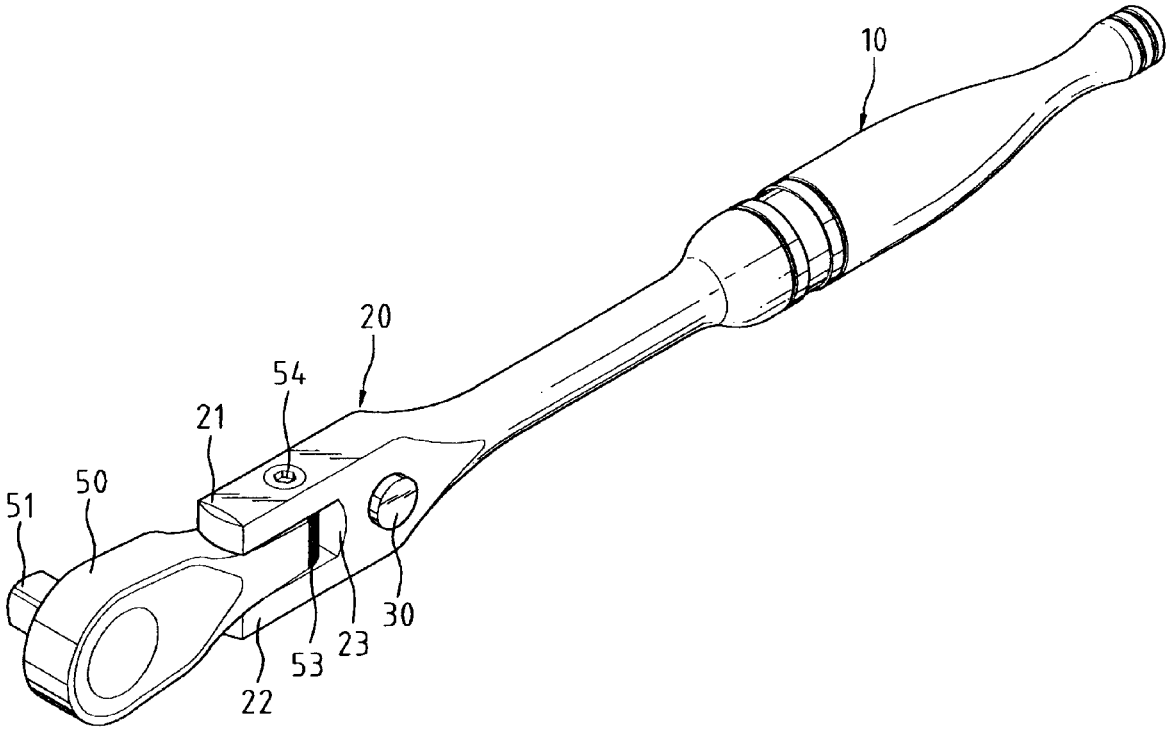

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1 and 2 is confirmed.

Claims 3 and 4 are cancelled.

* * * * *

US006216567C2

(12) EX PARTE REEXAMINATION CERTIFICATE (9626th)

United States Patent
Hu

(10) Number: US 6,216,567 C2
(45) Certificate Issued: May 2, 2013

(54) RATCHETING TOOLS HAVING AN ANGLE-ADJUSTABLE HEAD

(76) Inventor: Bobby Hu, Taichung (TW)

Reexamination Request:
No. 90/012,511, Sep. 12, 2012

Reexamination Certificate for:

| | |
|---|---|
| Patent No.: | **6,216,567** |
| Issued: | **Apr. 17, 2001** |
| Appl. No.: | **09/434,539** |
| Filed: | **Nov. 5, 1999** |

Reexamination Certificate C1 6,216,567 issued Nov. 1, 2011

(51) Int. Cl.
*B25B 23/16* (2006.01)

(52) U.S. Cl.
USPC ..... 81/177.9; 81/177.7; 81/177.6

(58) Field of Classification Search
None
See application file for complete search history.

(56) References Cited

To view the complete listing of prior art documents cited during the proceeding for Reexamination Control Number 90/012,511, please refer to the USPTO's public Patent Application Information Retrieval (PAIR) system under the Display References tab.

*Primary Examiner* — Russell Stormer

(57) ABSTRACT

A ratcheting tool includes a head including an end with an arcuate toothed face and a handle having an end defining a compartment for pivotal connection with the end of the head. The handle includes a longitudinal hole having an inner end and an outer end communicated with the compartment. The handle further includes a transverse hole communicated with the inner end of the longitudinal hole. A catch is mounted in the longitudinal hole and includes a first end with an arcuate toothed surface and a second end. A push button is mounted in the transverse hole and includes a stem, the stem including a relatively higher portion and a relatively lower portion. An elastic member biases the push button to a retaining position in which the second end of the catch engages with the relatively higher portion of the stem such that the arcuate toothed surface of the catch is biased to engage with the arcuate toothed face of the head, thereby retaining the head in an angular position relative to the handle. When the push button is pushed, the second end of the catch is disengaged from the relatively higher portion of the stem such that the arcuate toothed surface of the catch is disengaged from the arcuate toothed face of the head, thereby allowing adjustment of angular position of the head relative to the handle.

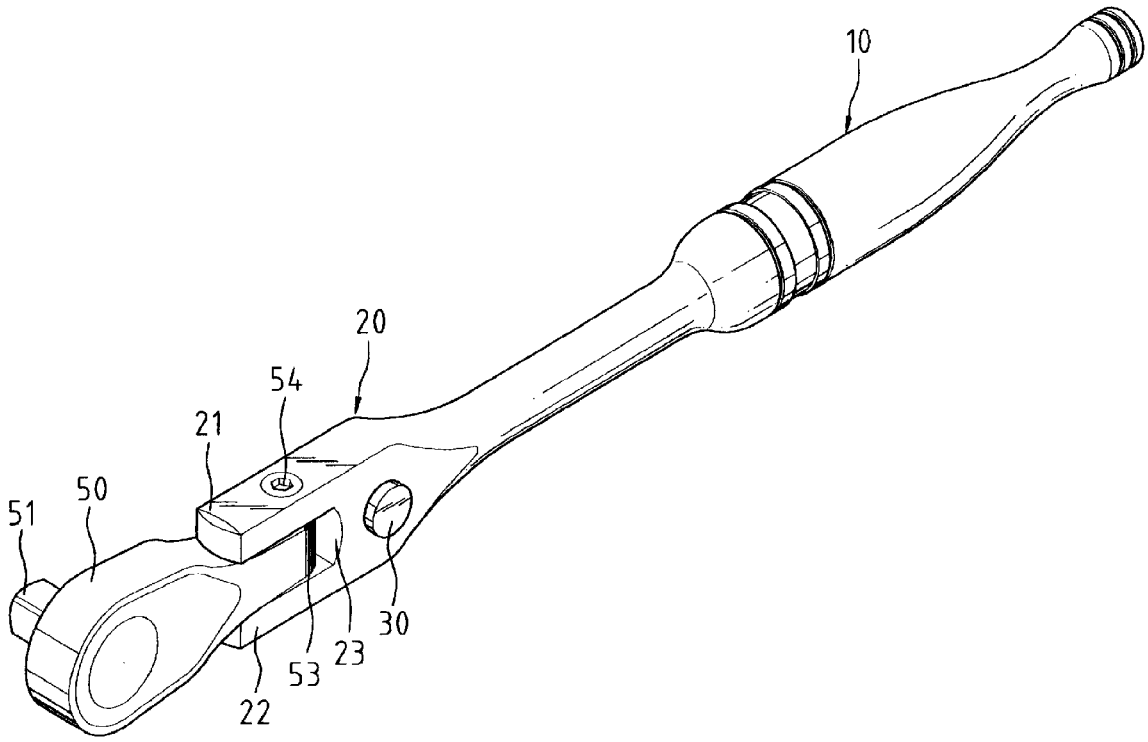

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 3 and 4 were previously cancelled.

Claims 1 and 2 are cancelled.

* * * * *